United States Patent [19]

Menchetti et al.

[11] Patent Number: 4,700,515

[45] Date of Patent: Oct. 20, 1987

[54] WALL PANEL LEVELING SUPPORT CLIP

[75] Inventors: Robert J. Menchetti, Buffalo; Robert M. Chapman, Appleton, both of N.Y.

[73] Assignee: National Gypsum Company, Dallas, Tex.

[21] Appl. No.: 6,187

[22] Filed: Jan. 23, 1987

[51] Int. Cl.[4] ..... E04B 2/82

[52] U.S. Cl. ..... 52/126.1; 52/243.1

[58] Field of Search ..... 52/126.1, 126.6, 359, 52/360, 712, 714, 238.1, 243.1

[56] References Cited

U.S. PATENT DOCUMENTS

| | | | |
|---|---|---|---|
| 1,624,187 | 4/1927 | Schlafly | 52/360 |
| 2,625,815 | 1/1953 | Black | 52/126.1 |
| 2,877,875 | 3/1959 | Bolt | 52/243.1 X |
| 3,073,068 | 1/1963 | Slowinski | 52/359 X |
| 3,232,018 | 2/1966 | MacKean | 52/360 X |
| 3,962,840 | 6/1976 | Nelsson | 52/714 X |
| 4,037,380 | 7/1977 | Pollock | 52/243.1 X |
| 4,255,914 | 3/1981 | Seipos | 52/714 X |
| 4,531,335 | 7/1985 | Mangan | 52/714 X |

FOREIGN PATENT DOCUMENTS

| | | | |
|---|---|---|---|
| 2417120 | 10/1975 | Fed. Rep. of Germany | 52/126.1 |

*Primary Examiner*—J. Karl Bell

*Attorney, Agent, or Firm*—Robert F. Hause; Laird F. Miller

[57] ABSTRACT

Formed sheet metal clips, affixed relative to a wall panel being mounted, support the panel on a central downwardly extending hump in the clip, which provides a pivot point permitting slight rotation of the vertically extending panel, for easy placement in exactly the desired vertical extent prior to affixing the panel in place, as by screws or adhesive. The clips may be affixed to the panel bottom or to a floor track and may additionally provide means for affixing a wall base trim.

20 Claims, 6 Drawing Figures

WALL PANEL LEVELING SUPPORT CLIP

BACKGROUND OF THE INVENTION

This invention relates to a novel support clip for placement below a wall panel bottom to permit easy alignment of the panel, vertically parallel to an adjacent previously erected panel, during construction of a partition.

In constructing a partition, a plurality of panels or wallboards are mounted, extending vertically, with a bottom end resting on the floor, or on a floor track which extends, fixedly, along the floor. The typical floor is of poured concrete which is seldom perfectly flat. With long slight curves in the floor, adjacent panels, resting on the floor, tend to have vertical extents which are not completely parallel, resulting in gaps between the edges of the panels, most pronounced near the tops. Considerable time and effort may be expended in overcoming this problem and forcing the panels into alignment as the partition erection progresses. U.S. Pat. No. 3,885,361 discloses a relatively complicated means for overcoming this problem. A simplified means for avoiding this extra time and effort has been needed.

SUMMARY OF THE INVENTION

The present invention consists of a preformed sheet metal leveling support clip, of a highly simplified form, which permits the original placement of a panel to be on a single small pivot point, along the panel bottom edge, which results in the panel top edge inherently resting tightly against the top edge of a previously placed panel, when the bottom edge is manually moved to a position tightly against the bottom edge of the previously placed panel.

Means are provided on the preferred embodiments of the leveling support clip for easily affixing the clip to the end of a panel, or to the floor track, at any position desired along the panel end, by affixing the clip to the panel end, or hanging the clip on an upwardly extending flange of the floor track.

It is an object of the invention to provide a simplified clip for temporarily supporting a large, ceiling height wall panel on a single small somewhat centralized pivot point, for very easy final adjustment of verticalness during affixation of the panel to framing members.

It is a further object to provide such a clip which is easily affixed relative to the end of a panel just prior to erection of the panel.

It is a still further object of the invention to provide a novel method of erecting wall panels, providing ease of proper placement of the panels relative to adjacent panels, regardless of the flatness of the floor.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
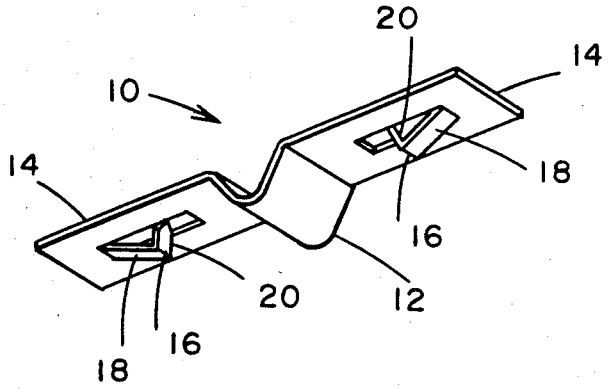
FIG. 1 is an isometric view of a leveling support clip formed in accordance with one embodiment of the invention.

Referring to FIG. 1, there is shown a leveling support clip 10 which has been formed from a sheet of galvanized steel, about 1/32 inch thick, three inches long and ½ inch wide. Clip 10 has a centered, downwardly protruding hump 12 extending downward about ¼ inch below the general plane of two outwardly directed panel supporting plates 14 affixed to each end of the hump 12.

Each panel supporting plate 14 is a little more than an inch long and has an elongated, narrow strip of sheet metal partially severed therefrom, forming a bendable arm 16, hingedly connected at one end to a plate 14. Each arm 16 has a first, downwardly angled hinged section 18 and a second, upwardly directed, pointed, panel penetrating prong section 20. Arm 16 is about ⅛ inch wide, hinged section 18 is about ⅜ inch long, and prong section 20 is about ¼ inch long, extending at about an 80° angle from hinged section 18.

Figure 2:
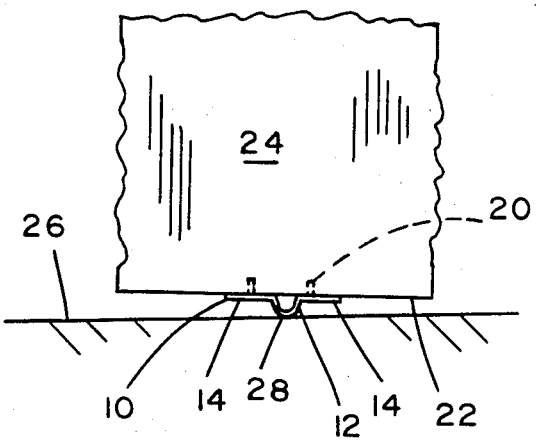
FIG. 2 is a front elevational view of the bottom portion of a partition, with the clip of FIG. 1 installed therein.

Referring to FIG. 2, clip 10 is shown attached to the bottom end 22 of a gypsum wallboard panel 24 with the hump 12 resting on a floor 26, which is not quite level. The bottom end 22 is, nevertheless, perfectly level, as is made possible by the single point of support of panel 24, at the peak 28 of hump 12. Clip 10 is attached to panel 24 by the arms 16 having been bent up to force prong sections 20 to penetrate into the bottom end 22 of panel 24.

Gypsum wallboard panel 24 is preferably about ½ inch thick, four feet wide, and about eight to twelve feet high.

Figure 3:
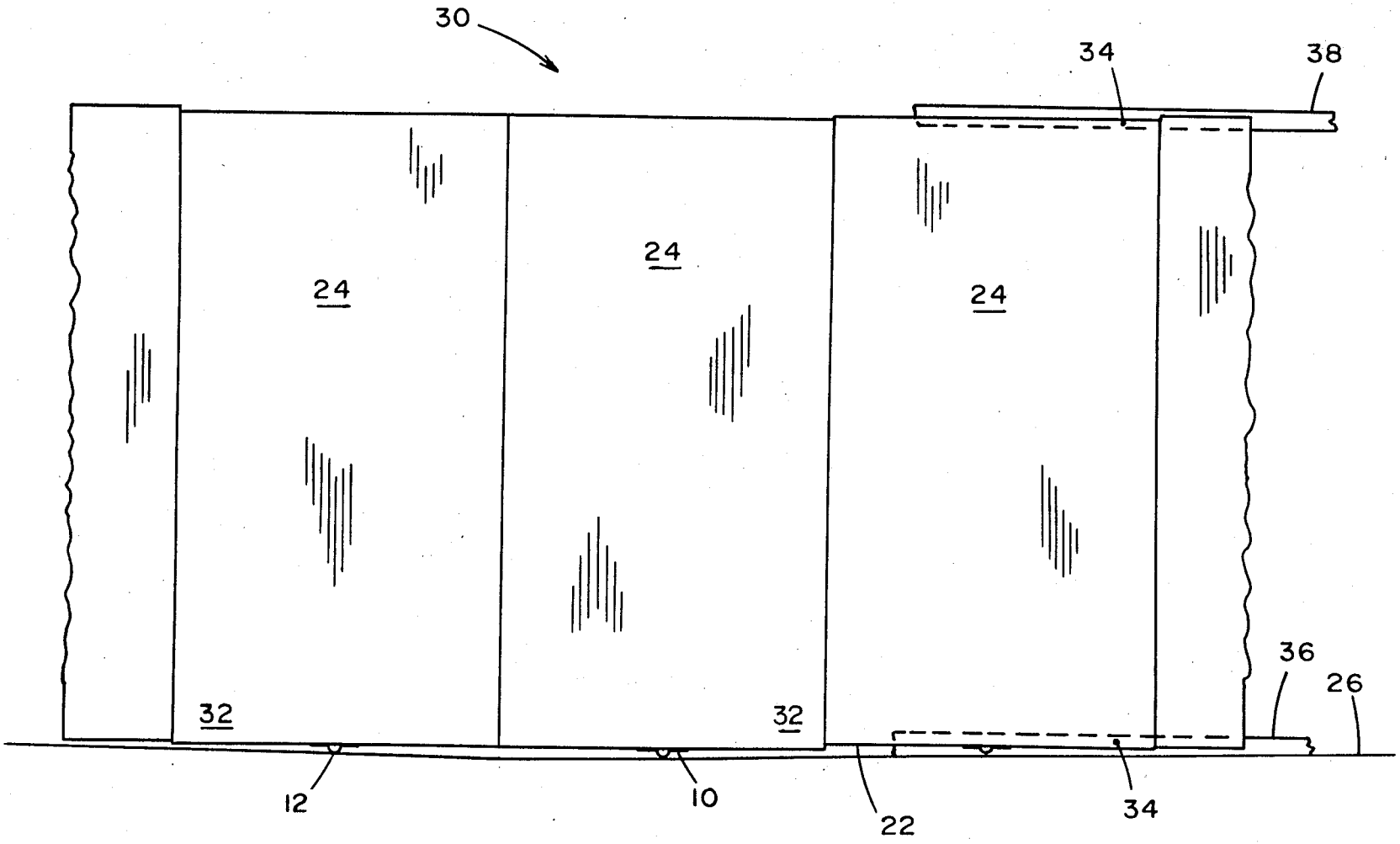
FIG. 3 is a front elevational view of a partition, including several panels, all erected in accordance with the invention.

The clips 10 may be attached to the bottom ends 22 of panels 24 prior to lifting the panel into place in a partition 30, and, as shown in FIG. 3, may be located at or near the center of the bottom ends 22, unless the slope of the non level floor 26 is so great that a bottom corner 32 of the panel, on the side where the floor 26 is high, touches the floor 26. In this case clip 10 will need to be placed off center, toward corner 32, to avoid any contact of panel 24 with floor 26. With the ¼ inch hump 12 and a four foot wide panel 24, the floor would need to have a slope of about ¼ inch in two feet to create the above discussed problem.

With less troublesome floors, no slope as great as ¼ inch per two feet, it will be found preferable to locate the clip 10 slightly off center, about one to ten inches, in a direction away from the previously erected panel. This will cause the panel 24 to inherently tend to tip toward the previously erected panel, closing any gap at the top between panels 24, as the panel 24 being erected is being affixed to a fixed framing member, such as by screw 34 affixing panel 24 to a floor track 36.

The partition 30 may be any of many different basic types of construction, insofar as the means for affixing the panels 24 to wall framing members. It is contemplated, in accordance with the invention that the panels will be affixedly held in place, such as by screw attachment of the panels 24 to studs, not shown, or edge grip clip attachment of the panel edges to studs plus screw attachment to floor and ceiling tracks, as shown for floor track 36 and ceiling track 38, or adhesive attachment of panels 24 to studs plus screw attachment to floor and ceiling tracks. Thus, in the preferred embodiments of the invention the clips 10 provide full support of panels 24 only temporarily, while the panels are being moved into place and somehow affixed, and subsequently the clips 10 function as partial support of panels 24, in cooperation with the means employed for affixing the panels in place.

Figure 4:
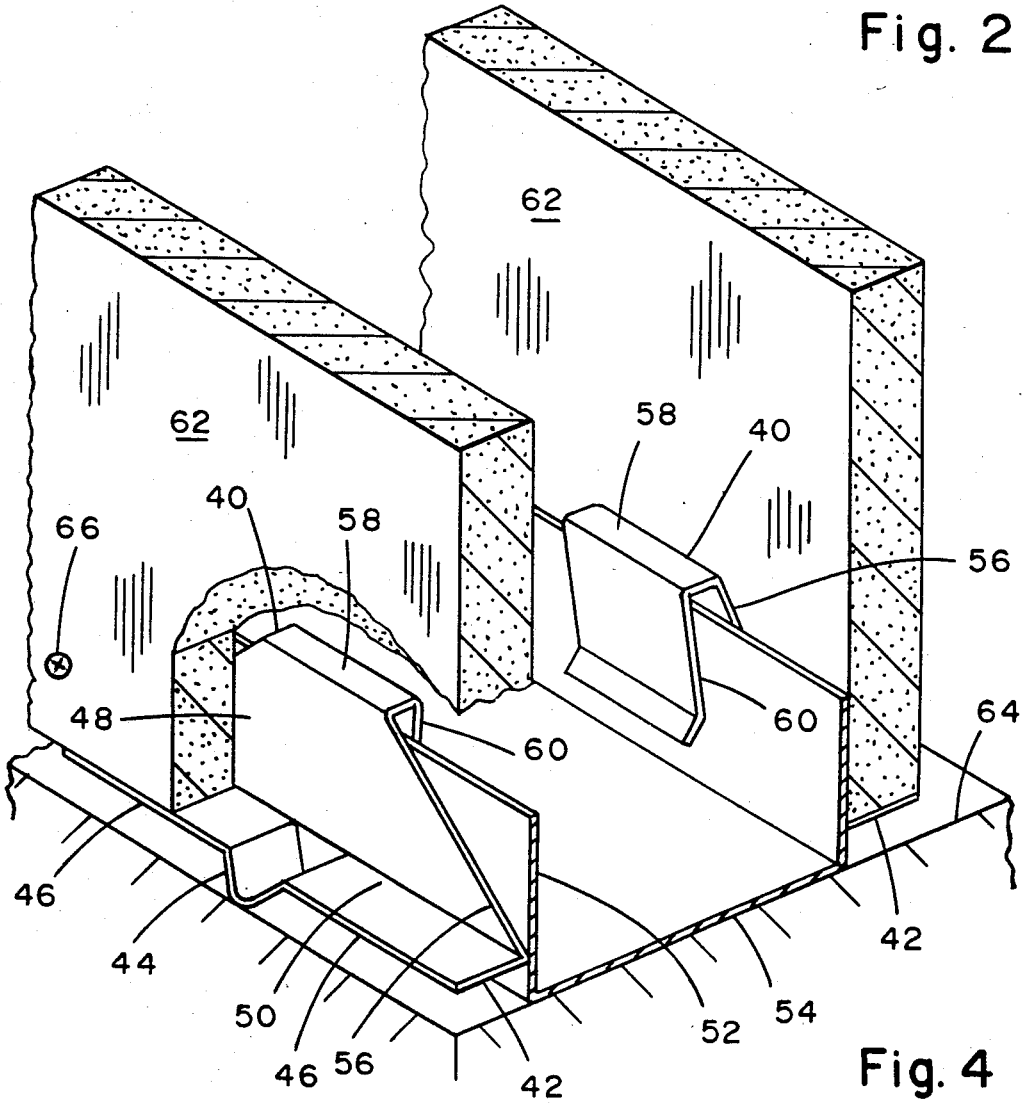
FIG. 4 is an isometric view of leveling support clips, affixed to a floor track, supporting wall panels in accordance with a second embodiment of the invention.

In FIG. 4, there is shown a cross section of bottom portion of a wall, including two modified leveling support clips 40, each formed from a sheet of galvanized steel, about 1/32 inch thick, with a base portion 42 which is about three inches long and ½ inch wide. Base portion 42 has a centered, downwardly protruding hump 44 extending downward about ¼ inch below the general plane of two outwardly directed panel supporting plates 46. Clips 40 further include an upwardly extending attachment portion 48, which is adjoined at its bottom edge to the side edge 50 of base portion 42.

Attachment portion 48 is formed to fit over and grasp an upwardly extending flange 52 of a floor track 54. Attachment portion 48 includes an inner upwardly extending wall 56, a short top web 58 and an outer downwardly extending leg 60. Wall 56 is substantially narrower at the top than at the bottom, to conserve metal. Leg 60 is angled inwardly for most of its downward extent and angled outwardly near the bottom, for ease of attachment of the attachment portion 48 onto the flange 52.

It is contemplated, in accordance with the invention, that prior to erecting each panel 62, a leveling support clip 40 is attached to a floor track flange 52, usually near the center of the desired placement of the panel 62, with the hump 44 resting on the floor 64. The panel 62 will be adjusted into a vertical position using the hump 44 as a pivot point, and, when in the desired vertical position, the panel 62 will be firmly affixed in position, such as by a plurality of screws 66 through panel 62 into floor track flange 52.

Figure 5:
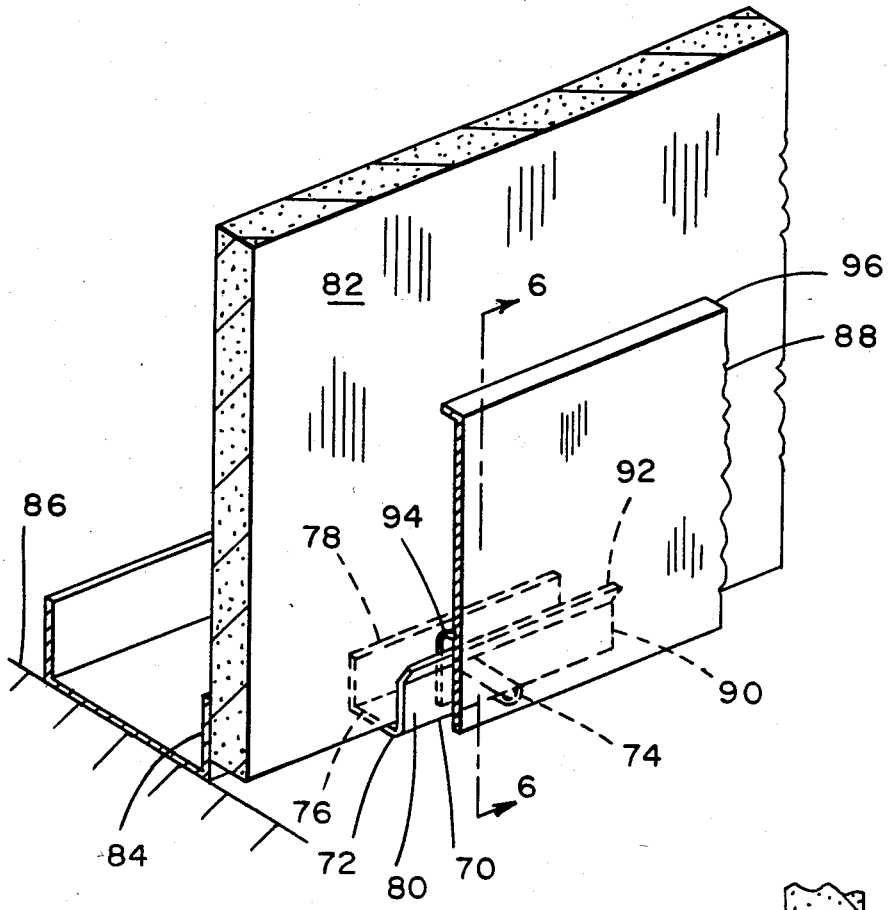
FIG. 5 is an isometric view of a third embodiment of the invention, with a leveling support clip having additional means for attachment thereto of a wall base trim.
Figure 6:
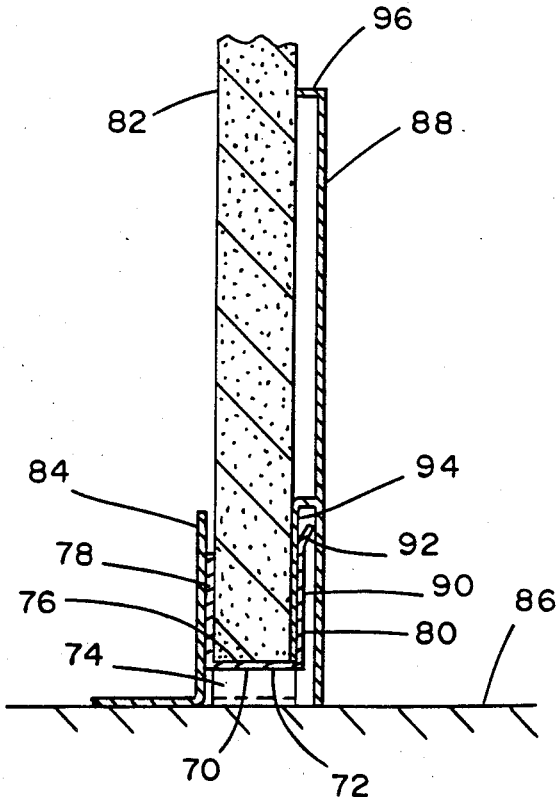
FIG. 6 is an end vertical sectional view of the leveling support clip of FIG. 5 holding a base trim against a panel, taken on line 6—6 thereof.

FIGS. 5 and 6 show a further modified form of leveling support clip 70, formed from a sheet of galvanized steel, about 1/32 inch thick, with a base portion 72 which is about three inches long and ½ inch wide. Base portion 72 has a centered downwardly protruding hump 74 extending downward about ¼ inch below the general plane of two outwardly directed panel supporting plates 76. Clip 70 further includes an inner upwardly extending flange 78 and an outer upwardly extending flange 80, each of which flanges 78, 80 are joined along the bottom to one of the sides of the panel supporting plates 76.

The two flanges 78, 80 are in a suitable parallel spaced relation to be placed on the bottom edge of a panel 82, normally near the center, and grasp the panel, retaining clip 70 in place on panel 82 during the initial placement of panel 82. The inner flange 78 is placed against a floor track flange 84 and the hump 74 rests on the floor 86, making it very easy to align panel 82 vertically, by pivoting the panel on hump 74.

In the embodiment shown, clip 70 is also adapted to receive and retain a base trim 88. The outer flange 80 is formed to include a slightly inwardly extending lower portion 90 with a very narrow outwardly extending upper portion 92, making it easy to place the clip 70 on the bottom of panel 82, and providing a thin groove, between flange 80 and panel 82, into which a downwardly extending flange 94, on the inner side of base trim 88, is inserted. Base trim 88 extends from floor 86 upward about four inches to a top inwardly extending short horizontal flange 96, which abuts panel 82.

In the modified clips 40 and 70, the downwardly extending hump 44 and 74 is formed by making a short slit at the side of the base portion 42 and 72, severing the metal from adjacent upwardly extending metal, and stretching the metal downward to essentially a short U-shaped or V-shaped hump 44 and 74, similar to the hump 12 of clip 10.

Having completed a detailed disclosure of the preferred embodiments of our invention so that those skilled in the art may practice the same, we contemplate that variations may be made without departing from the essence of the invention or the scope of the appended claims.

We claim:

1. A panel leveling support clip comprising a small elongate strip of relatively rigid sheet metal having a downwardly protruding hump, for providing a floor engaging pivot point, and two outwardly directed panel supporting plates, affixed one to each end of said hump, for providing a panel bottom edge supporting surface, said clip further having means for holding said clip in a desired position below a panel as said panel is being adjusted vertically into a desired vertical extent.

2. A clip as defined in claim 1 wherein said means for holding said clip is a bendable arm having a panel penetrating prong section.

3. A clip as defined in claim 2 wherein each said supporting plate has a bendable arm with a prong section partially severed therefrom, for penetration of the prong section into the bottom end of a panel.

4. A clip as defined in claim 3 wherein said clip is formed from an elongate narrow strip of sheet metal about three inches long and about ½ inch wide.

5. A clip as defined in claim 1 wherein said means for holding said clip is a portion of sheet metal extending upwardly from a side edge of said panel supporting plates and formed to fit over and grasp an upwardly extending floor track flange.

6. A clip as defined in claim 5 wherein said holding means include an inner upwardly extending wall, a short top web and an outer downwardly extending leg.

7. A clip as defined in claim 1 wherein said means for holding said clip is two upwardly extending portions of sheet metal, one extending upwardly from each side edge of said panel supporting plates, formed to grasp the two faces of a panel at a bottom end of said panel.

8. A clip as defined in claim 7 wherein one of said upwardly extending portions is formed to receive and retain a base trim strip.

9. A panel leveling support clip comprising means for holding said clip in a desired position below a panel during erection of said panel, and means for supporting the weight of a panel during erection of said panel, said means for supporting the weight of a panel including an elongate strip of rigid metal having a downwardly protruding floor engaging hump for providing a floor engaging pivot point.

10. A clip as defined in claim 9 wherein said clip is formed from an elongate strip of rigid metal of about three inches in length.

11. A partition comprising a plurality of rectangular wall panels having lengths extending vertically, with vertical side edges of said panels all being in tight abutment with the side edge of an adjacent panel, said panels each being at least partially supported by a single support clip as defined in claim 9.

12. A partition as defined in claim 11 wherein said wall panels are paper covered gypsum core wallboards and said means for holding said clip in a desired position is a bendable arm having a panel penetrating prong section, said prong section being located within the gypsum core of said wallboard bottom end.

13. A partition as defined in claim 11 wherein said means for holding said clip in a desired position is a portion of sheet metal extending upwardly from a side edge of said means for supporting the weight of a panel and formed to fit over a floor track flange, said upwardly extending portion grasping said floor track flange.

14. A method of erecting rectangular wall panels having a longer dimension extending substantially vertically, comprising the steps of placing a rectangular wall panel in a desired position in a partition under construction with a single panel leveling support clip, as defined in claim 9, disposed under the bottom end of said panel and resting with said hump on a floor thereunder, rotating said panel slightly around the pivot point formed by said hump resting on said floor, rotating said panel sufficiently to place said panel in the desired vertical position, and affixing said panel to prevent further rotation of said panel around said pivot point.

15. The method of claim 14 wherein said clip is affixed to the bottom end of said panel prior to said placing of said panel in position.

16. The method of claim 14 wherein said clip is affixed relative to the floor prior to said placing of said panel in position.

17. The method of claim 14 wherein said panel being erected is placed next to a previously erected panel and said floor is slightly sloped, further comprising the step of placing the bottom of said panel being erected tightly against the bottom of said previously erected panel and subsequently rotating said panel to cause the top of said panel being erected to become tight against the top of said previously erected panel, and permanently affixing said panel being erected into said tightly disposed position.

18. The method of claim 17 wherein said floor is sloped downwardly and away from said previously erected panel, and said panel leveling support clip is affixed in place relative to the panel bottom, during said rotating, said clip hump being located a distance away from said previously erected panel which is over one-half the width of said panel being erected, whereby the weight of said panel on said clip will cause said rotation toward said previously erected panel.

19. The method of claim 18 wherein said clip is affixed to the bottom end of said panel prior to said placing of said panel in position.

20. The method of claim 19 wherein said clip is affixed relative to the floor prior to said placing of said panel in position.

* * * * *